US010871345B2

(12) United States Patent
Faifer

(10) Patent No.: US 10,871,345 B2
(45) Date of Patent: Dec. 22, 2020

(54) PISTOL CHASSIS AND FIREARM APPARATUS

(71) Applicant: Sagi Faifer, Mishmar Hashiva (IL)

(72) Inventor: Sagi Faifer, Mishmar Hashiva (IL)

( * ) Notice: Subject to any disclaimer, the term of this patent is extended or adjusted under 35 U.S.C. 154(b) by 0 days.

(21) Appl. No.: 16/252,791

(22) Filed: Jan. 21, 2019

(65) Prior Publication Data

US 2019/0226797 A1 Jul. 25, 2019

Related U.S. Application Data

(60) Provisional application No. 62/620,907, filed on Jan. 23, 2018, provisional application No. 62/620,886, filed on Jan. 23, 2018.

(51) Int. Cl.

| | |
|---|---|
| ***F41C 23/12*** | (2006.01) |
| ***F41C 27/22*** | (2006.01) |
| ***F41C 33/00*** | (2006.01) |
| ***F41A 3/72*** | (2006.01) |
| ***F41C 23/04*** | (2006.01) |

(52) U.S. Cl.

CPC ..... *F41C 23/12* (2013.01); *F41A 3/72* (2013.01); *F41C 23/04* (2013.01); *F41C 27/22* (2013.01); *F41C 33/001* (2013.01)

(58) Field of Classification Search

CPC ..... F41C 23/12; F41C 23/10; F41C 23/00; F41A 11/02; F41A 3/72

See application file for complete search history.

(56) References Cited

U.S. PATENT DOCUMENTS

| | | | | |
|---|---|---|---|---|
| 1,877,016 | A | 9/1932 | Munson | |
| 2,139,691 | A | 12/1938 | Michal, Jr. | |
| 3,029,539 | A | 4/1962 | Glass et al. | |
| 3,369,316 | A | 2/1968 | Miller | |
| D212,219 | S | 9/1968 | Crouch | |
| D212,220 | S | 9/1968 | Crouch | |
| 3,685,194 | A | 8/1972 | Coon | |
| 3,977,297 | A | 8/1976 | Orozco | |
| 3,987,571 | A | 10/1976 | Orozco | |
| 4,271,623 | A | 6/1981 | Beretta | |
| 4,291,482 | A | 9/1981 | Bresan | |
| D262,478 | S | 12/1981 | Beuchat | |
| 4,735,007 | A | 4/1988 | Gal | |
| 4,788,785 | A | 12/1988 | White | |
| 4,833,970 | A | 5/1989 | Wilhelm | |
| 5,004,444 | A | 4/1991 | Chih | |
| 6,318,014 | B1 | 11/2001 | Porter | |
| D641,062 | S * | 7/2011 | Faifer | D22/103 |
| 8,448,366 | B2 * | 5/2013 | Faifer | F41C 23/04 42/71.01 |

(Continued)

*Primary Examiner* — Derrick R Morgan
(74) *Attorney, Agent, or Firm* — Law Office of Arthur M. Antonelli, PLLC

(57) ABSTRACT

A pistol chassis is disclosed which may include a lower housing, an upper housing, a proximal enclosure, a distal sleeve, and a proximal accessory. The distal sleeve, lower housing, and upper housing may be secured together to form a tubular member for receiving a pistol. The lower housing further may include a distal segment, a proximal segment and an intermediate segment. Time distal segment may include a pistol frame receptacle and a trigger guard enclosure. The proximal accessory may be a folding stock. The pistol chassis may house a pistol to produce a firearm apparatus.

20 Claims, 18 Drawing Sheets

(56) References Cited

U.S. PATENT DOCUMENTS

| | | | | |
|---|---|---|---|---|
| D696,374 | S * | 12/2013 | Faifer | D22/104 |
| 8,887,432 | B2 * | 11/2014 | Oz | F41A 35/06 42/71.01 |
| 9,297,613 | B2 * | 3/2016 | Maentymaa | F41G 1/00 |
| 10,161,709 | B1 * | 12/2018 | Wright | F41C 9/00 |
| 2009/0282718 | A1 * | 11/2009 | Bartley | F41C 23/12 42/75.03 |
| 2009/0277066 | A1 | 12/2009 | Burt et al. | |
| 2011/0088305 | A1 * | 4/2011 | Oz | F41C 23/12 42/69.01 |
| 2011/0107644 | A1 * | 5/2011 | Faifer | F41C 23/04 42/75.02 |
| 2012/0131829 | A1 * | 5/2012 | Fistikchi | F41A 3/72 42/1.06 |
| 2013/0247440 | A1 * | 9/2013 | Maentymaa | F41G 1/00 42/111 |
| 2015/0316346 | A1 * | 11/2015 | Brandt | F41C 23/12 42/71.02 |
| 2016/0146558 | A1 * | 5/2016 | Kada | F41A 3/56 42/16 |
| 2017/0205189 | A1 * | 7/2017 | Rogers | F41A 19/11 |
| 2018/0224233 | A1 * | 8/2018 | Macy | F41A 19/12 |
| 2019/0017777 | A1 * | 1/2019 | Wilson | F41C 23/12 |
| 2019/0195595 | A1 * | 6/2019 | Kielsmeier | F41C 23/04 |

* cited by examiner

PISTOL CHASSIS AND FIREARM APPARATUS

CROSS-REFERENCE TO RELATED APPLICATIONS

This application claims the benefit of U.S. Provisional Application No. 62/620,907 filed on Jan. 23, 2018. Also, this application claims the benefit of U.S. Provisional Application No. 62/620,886 filed on Jan. 23, 2018. The disclosure of each of these applications is incorporated by reference herein in their entirety.

FIELD OF THE INVENTION

The invention generally relates to a frame for a firearm. More particularly, the invention relates to a pistol chassis and firearm apparatus.

BACKGROUND

Attachments for pistols are known in the related art. These attachments may be secured to a pistol to provide a platform for mounting tactical accessories. These attachments may be cumbersome to assemble, handle or deploy.

SUMMARY

Hence, the present disclosure is directed toward a pistol chassis and firearm apparatus. The pistol chassis may include a lower housing, an upper housing, a proximal enclosure, a distal sleeve, and a proximal accessory. The distal sleeve, lower housing, and upper housing may be secured together to form a tubular member for receiving a pistol. The lower housing may include a distal end and a proximal end. The lower housing further may include a distal segment, a proximal segment and an intermediate segment. The distal segment may include a pistol frame receptacle and a trigger guard enclosure.

The trigger guard enclosure may include a first wall which includes a first fastener receiving hole. The trigger guard enclosure further may include a second wall spaced from the first wall, the second wall including a second fastener receiving hole. The trigger guard enclosure may include a third wall disposed between the first wall and the second wall. The trigger guard enclosure further may include a trigger guard seat.

The trigger guard seat may include a trigger guard contact surface, a spring guide surface spaced from the trigger guard contact surface, a first side wall, a second side wall, a spring guide extending from the spring guide surface, a compression spring disposed around the spring guide, an elongated slot extending from the first side wall to the second side wall, and a trigger guard retention pin. The trigger guard retention pin may be disposed in the first fastener receiving hole, the elongated slot, and the second fastener receiving hole.

The lower housing further may include a proximal segment that includes a blocking element for a latching mechanism, as well as a track for guiding telescopic movement of the proximal enclosure. The lower housing also may include an intermediate segment. The intermediate segment may be situated between the distal segment and proximal segment. The intermediate segment may include a lower opening for receiving a pistol, as well as a starboard opening for passage of extracted ammunition casings tired by the pistol.

The proximal enclosure may be connected to the proximal segment. The proximal enclosure may include a projection and a clamping surface which is configured and dimensioned to interlock with a pistol grip dovetail. The proximal enclosure may further include a proximal latch for selectively locking the proximal enclosure to the intermediate segment. The proximal enclosure may be telescopically received over the proximal segment. The projection may be positioned in the track, and the clamping surface may be disposed opposite the pistol frame receptacle.

The upper housing may include a longitudinal axis, as well as an accessory rail and a charging handle track. Further, the upper housing may include a charging handle assembly positioned in the charging handle track. The charging handle assembly may include a handle and a rail. The rail may include a slide bracket. Also, the rail may include an elongated aperture. Additionally, the charging handle assembly may include a charging handle retention pin, and the accessory rail may include a retention pin opening. The charging handle retention pin may be disposed in the retention pin opening and the elongated aperture.

A proximal accessory may be connected to the proximal enclosure. The proximal accessory may include a buttstock. The proximal accessory may be a folding stock. Alternatively, the proximal accessory may include an arm stabilizing device. The proximal accessory may include an arm support. The arm support may form part of a yolk for resting on a forearm of an operator. The proximal accessory and the pistol chassis may form a hinge about an accessory coupling site. The arm support may be selectively rotatable about the accessory coupling site to achieve a more compact or folded configuration.

Also, the pistol chassis may house a pistol to produce a firearm apparatus. The firearm apparatus may include a pistol disposed in the lower housing, the pistol contacting the trigger guard seat and the clamping surface.

DESCRIPTION OF THE DRAWINGS

In the accompanying drawings, which form part of this specification and are to be read in conjunction therewith and in which like reference numerals are used to indicate like parts in the various views.

DESCRIPTION

Figure 1:
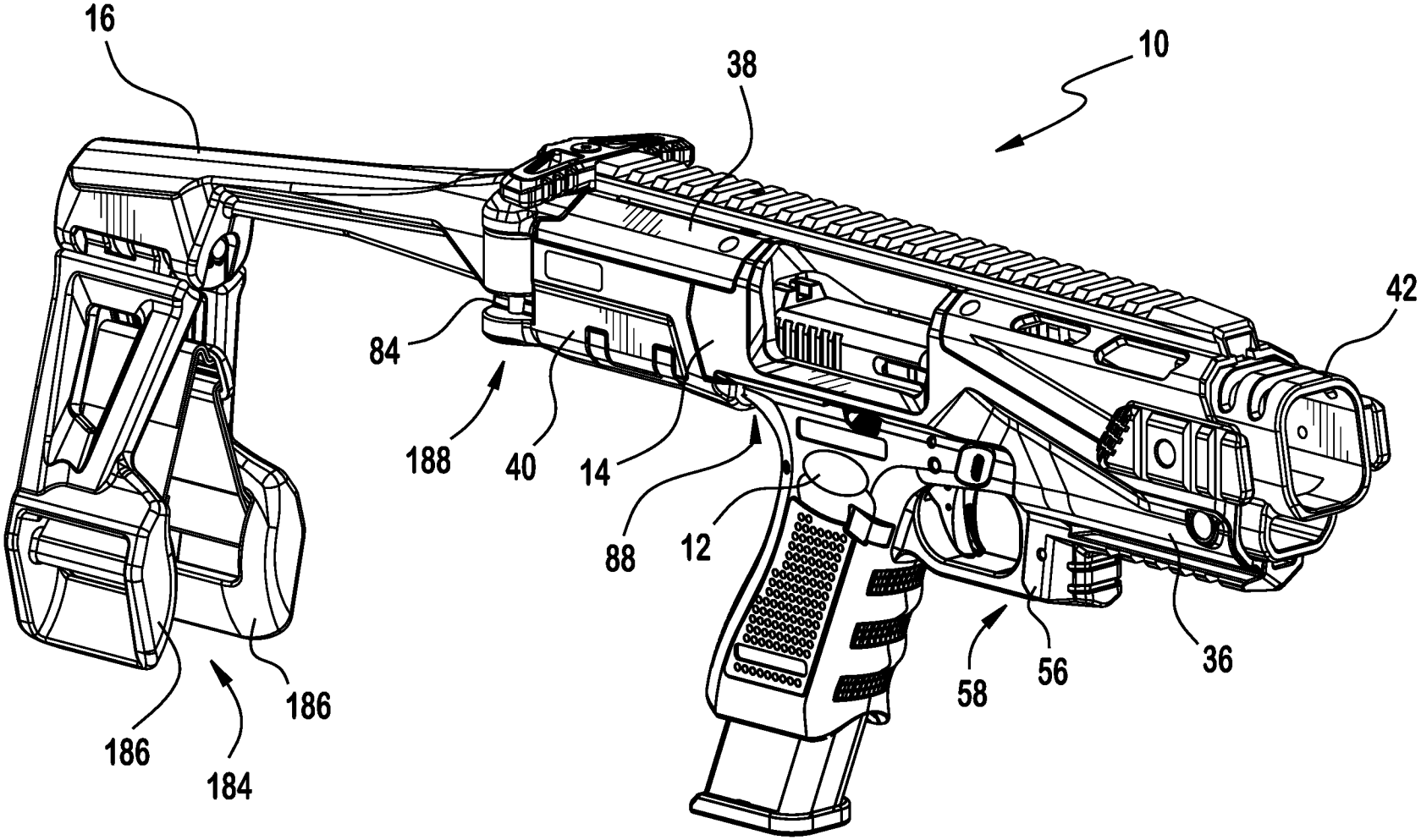
FIG. 1 is a perspective view of an exemplary pistol chassis in a deployed configuration and a firearm apparatus in an assembled configuration.
Figure 18:
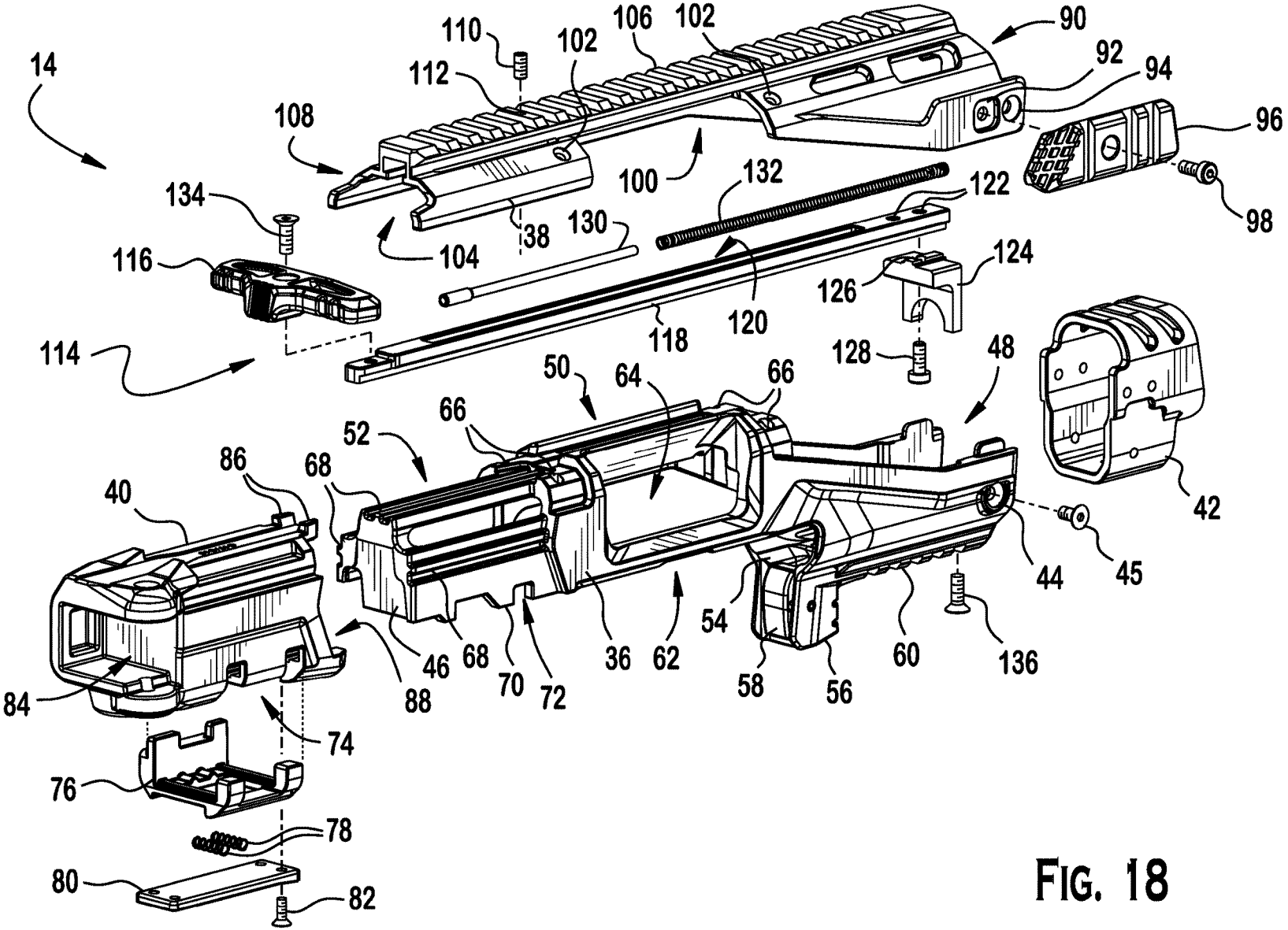
FIG. 18 is an exploded view of the pistol chassis of FIG. 1.
Figure 19:
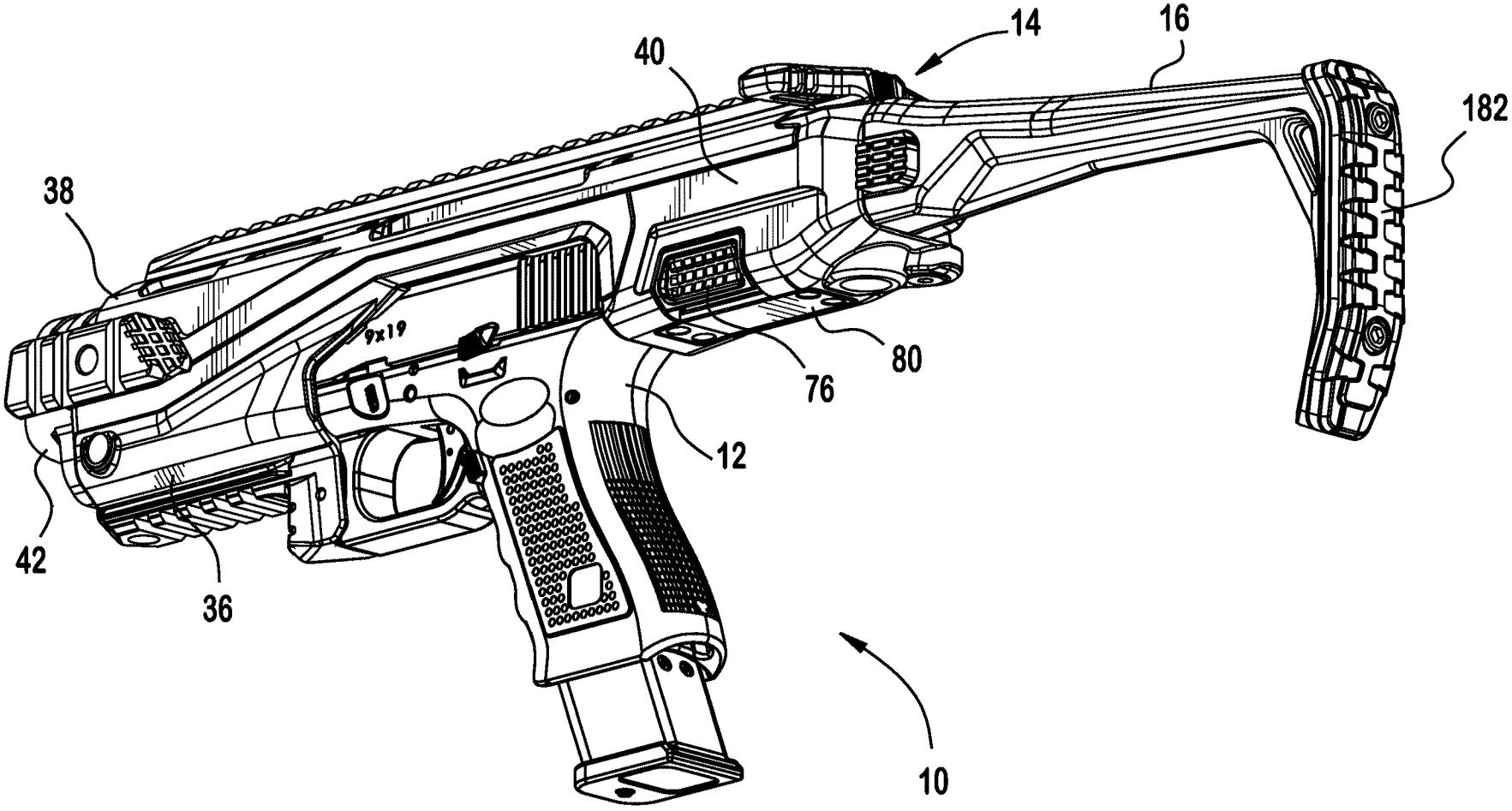
FIG. 19 is a perspective view of the firearm apparatus of FIG. 1 with a folding buttstock.

FIG. 1 shows a perspective view of an exemplary firearm apparatus 10. The firearm apparatus may include a pistol 12, a pistol chassis 14, and a proximal accessory 16. The proximal accessory 16 may be an arm support. The arm support may be adapted to engage with the forearm of a party properly grasping the pistol 12. The arm support may be adapted to stabilize the firearm apparatus 10 against the party's forearm independent of any support from the shoulder or side of the user's body. The proximal accessory may be readily demounted from the pistol chassis. For example, as shown in FIG. 18, the pistol chassis 14 may include an accessory coupling site 84. The accessory coupling site 84 may be configured and adapted to receive a hinge such that the proximal accessory 16 may fold against the pistol chassis 14 in a stored configuration. Also, the proximal accessory 16 may be collapsible and/or fixed. Referring to FIG. 19, in yet another embodiment of the firearm apparatus 10, the proximal accessory 16 may be a folding stock (or buttstock). Also, the stock may be collapsible and/or fixed.

Figure 2:
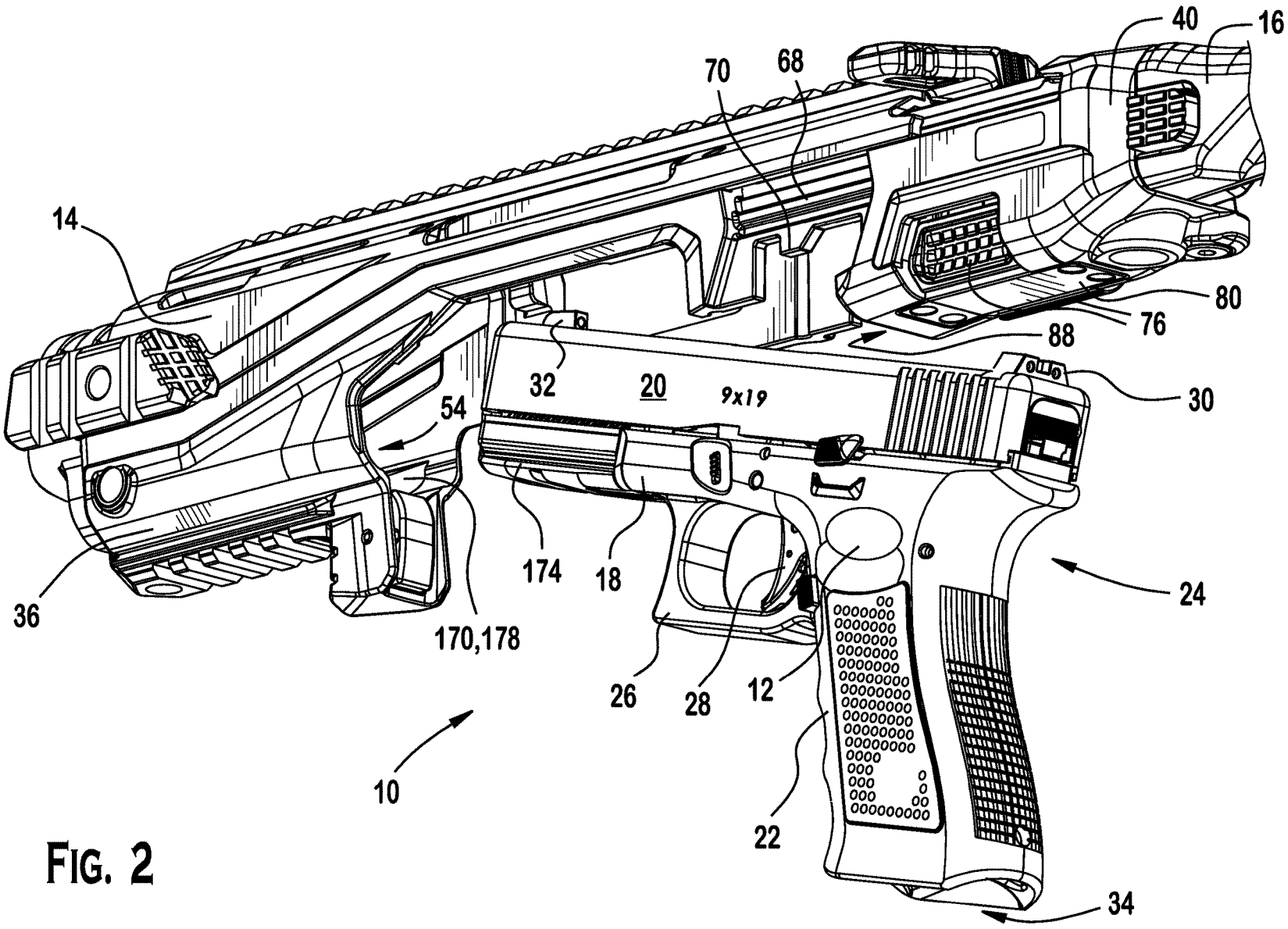
FIG. 2 is a perspective view of the firearm apparatus of FIG. 1 in a disassembled configuration.

FIG. 2 shows a perspective view of the exemplary firearm apparatus 10 in a disassembled configuration, in which the pistol 12 is separated from the pistol chassis 14. Additionally, the pistol chassis 14 is shown in an open or pre-deployment configuration. By contrast, as shown in FIGS. 1, 6, 7, and 14, the pistol 12 and the pistol chassis 14 may mate securely and in a locked configuration for deployment of the firearm apparatus. Referring to FIG. 2, features of the pistol 12 that may be accommodated or mated to the pistol chassis 14 may include, without limitation, the frame 18, slide 20, grip 22, dovetail 24, trigger guard 26, trigger 28, rear sight 30, front sight 32, and the magazine well 34.

FIG. 18 shows an exploded view of the exemplary embodiment of the pistol chassis 14. The pistol chassis 14 may include a lower housing 36, and upper housing 38, and a proximal enclosure 40. The pistol chassis 14 may further include a distal sleeve 42. These components may be joined to form a tubular member for securely receiving and housing the pistol 12 and proximal accessory 16. Preferably, the lower housing 36 and proximal enclosure 40 may be formed from a reinforced polymer material, whereas, the upper housing 38 may be formed from metal (e.g., aluminum or an aluminum alloy). Similarly, the distal sleeve 42 preferably may be formed from a metal.

Figure 11:
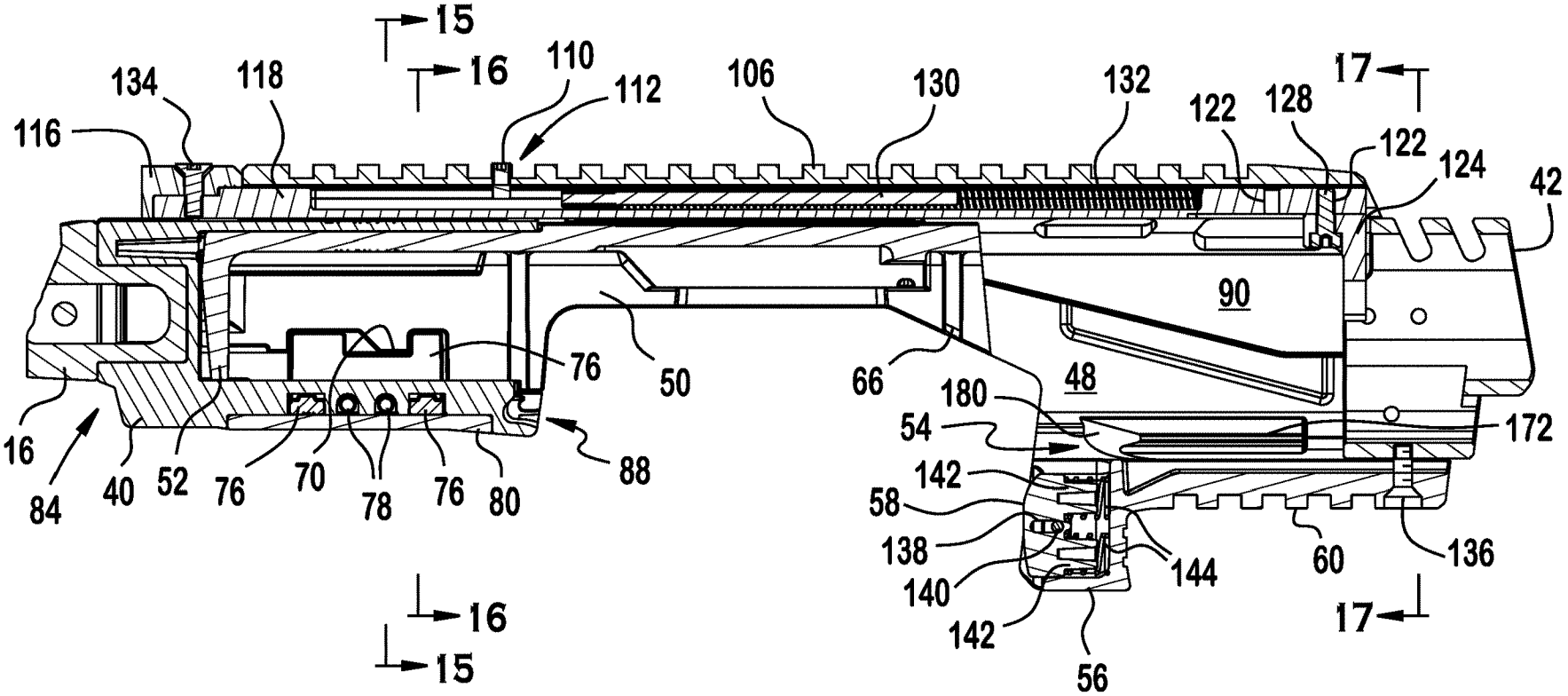
FIG. 11 is a partial sectional view of the pistol chassis of FIG. 1.
Figure 12:
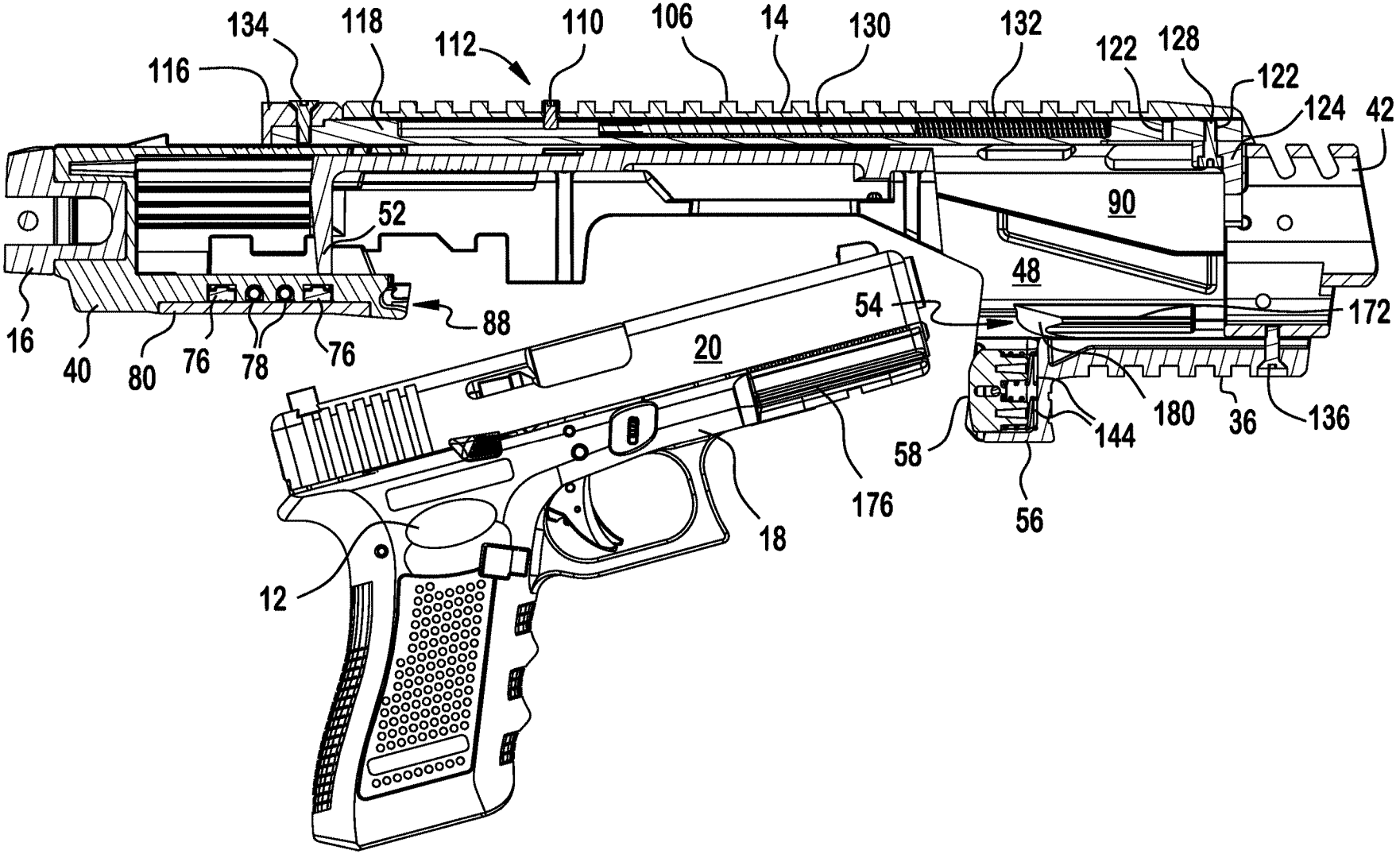
FIG. 12 is a partial sectional view of the firearm apparatus of FIG. 3.
Figure 13:
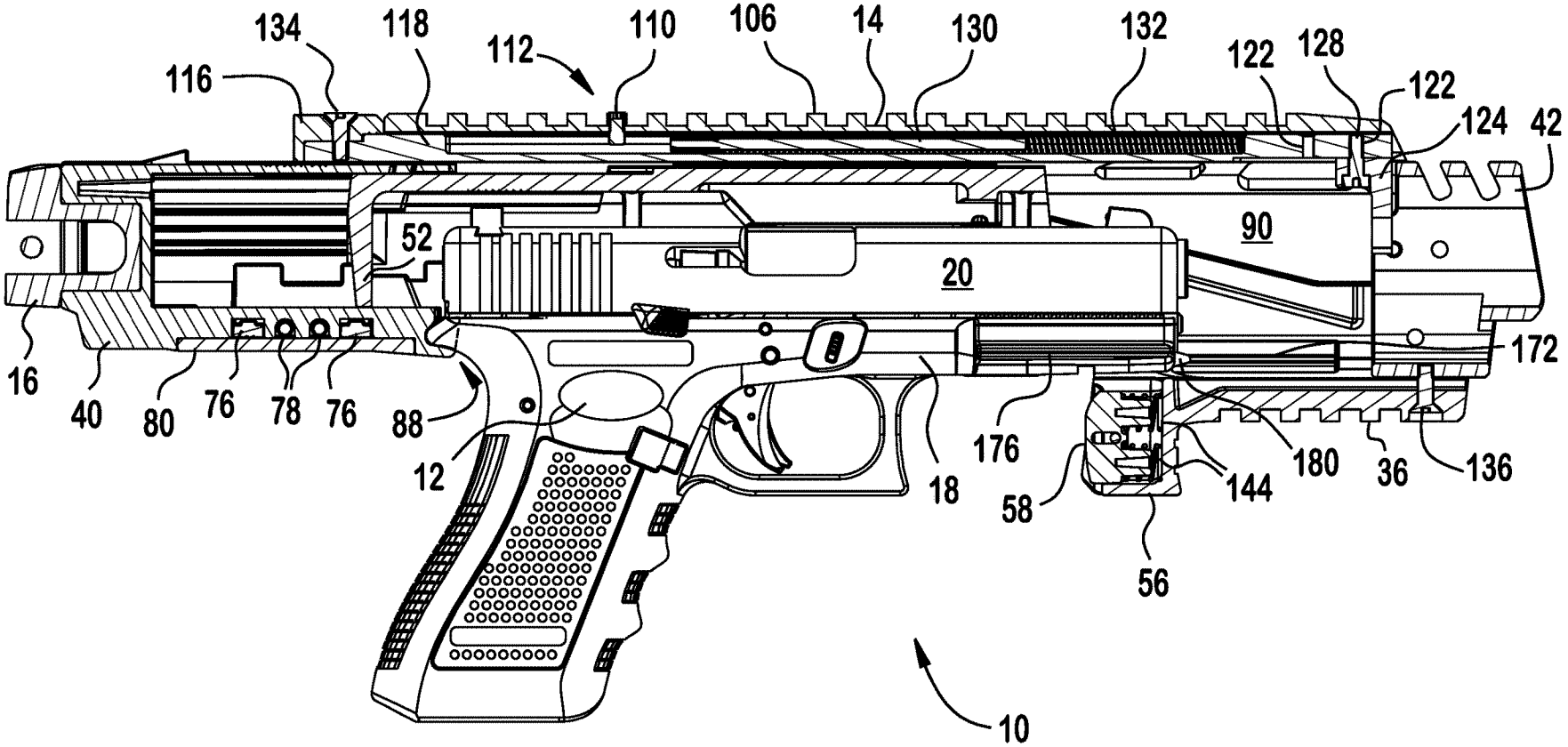
FIG. 13 is a partial sectional view of the firearm apparatus of FIG. 5.

Referring to FIGS. 11 and 18, the lower housing 36 may include a distal end 44 and a proximal end 46. Also, the lower housing 36 may include a distal segment 48, an intermediate segment 50, and a proximal segment 52. The distal segment 48 of the lower housing 36 may include a pistol frame receptacle 54 which is configured and dimensioned to slidably mate with a pistol accessory rail (e.g., picatinny rail) that is mounted under the barrel.

Figure 3:
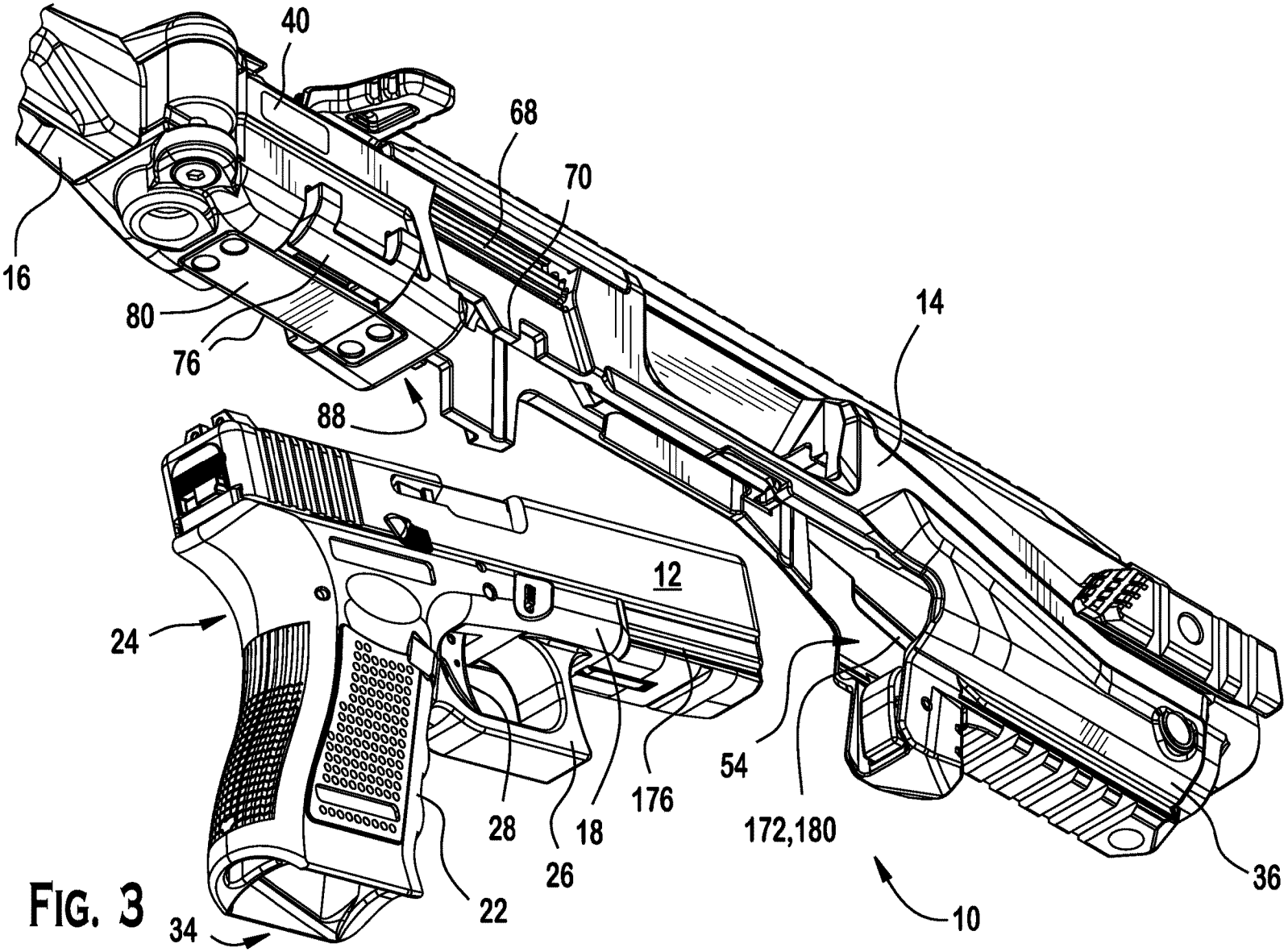
FIG. 3 is another perspective view of the firearm apparatus of FIG. 2.
Figure 4:
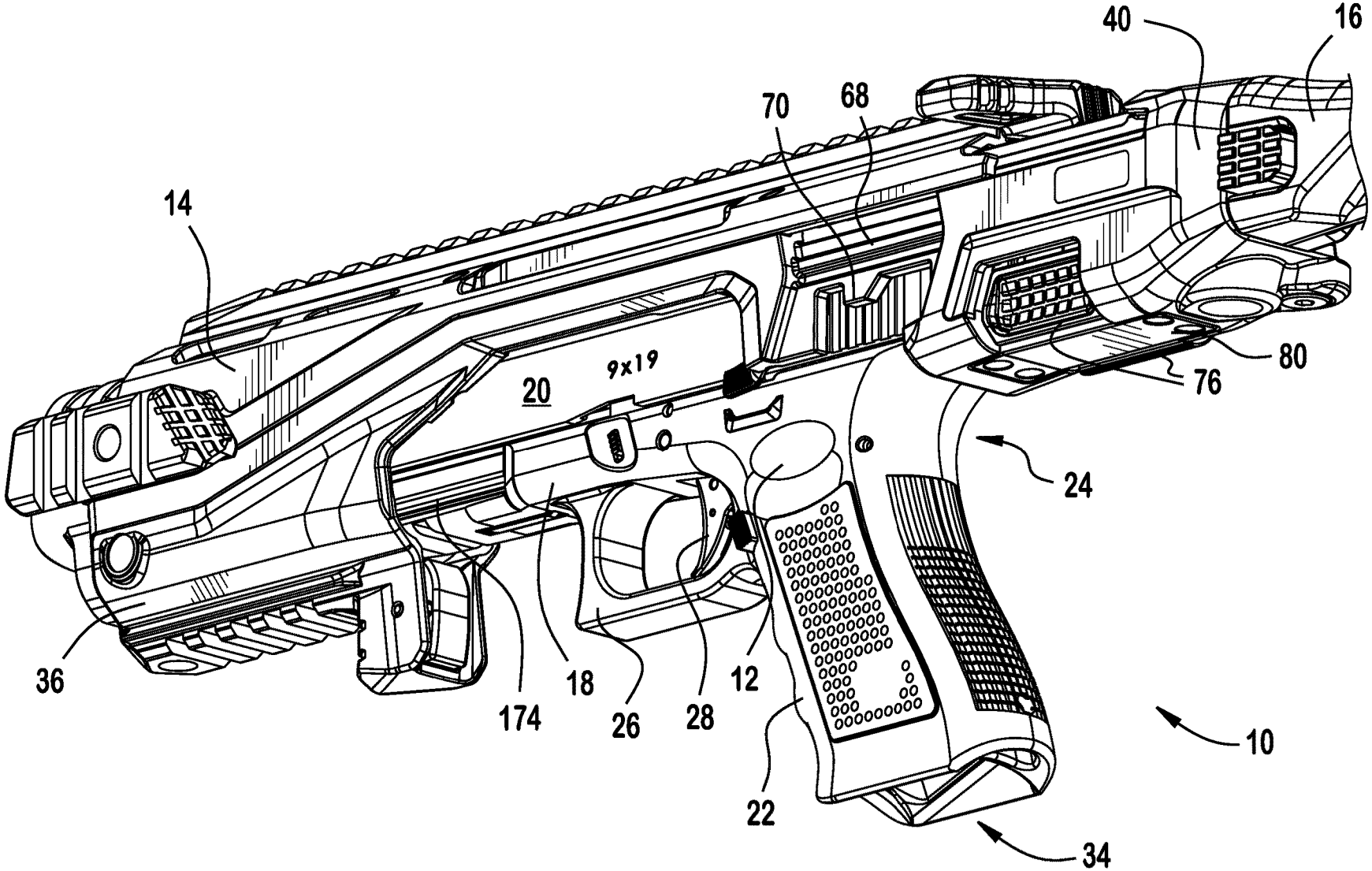
FIG. 4 is a perspective view of the firearm apparatus of FIG. 1 in a partially assembled configuration.
Figure 5:
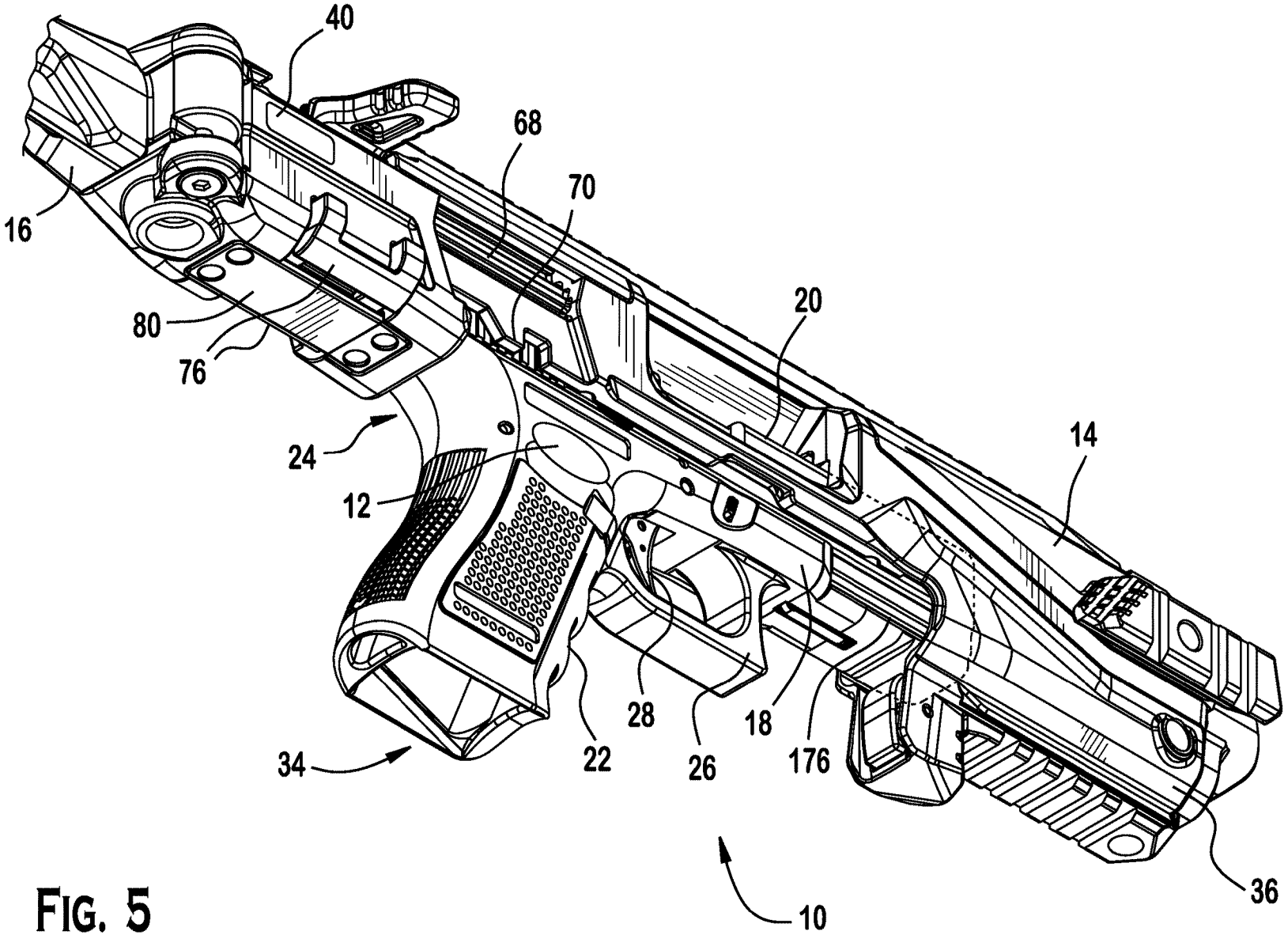
FIG. 5 is another perspective view of the firearm apparatus of FIG. 4.
Figure 6:
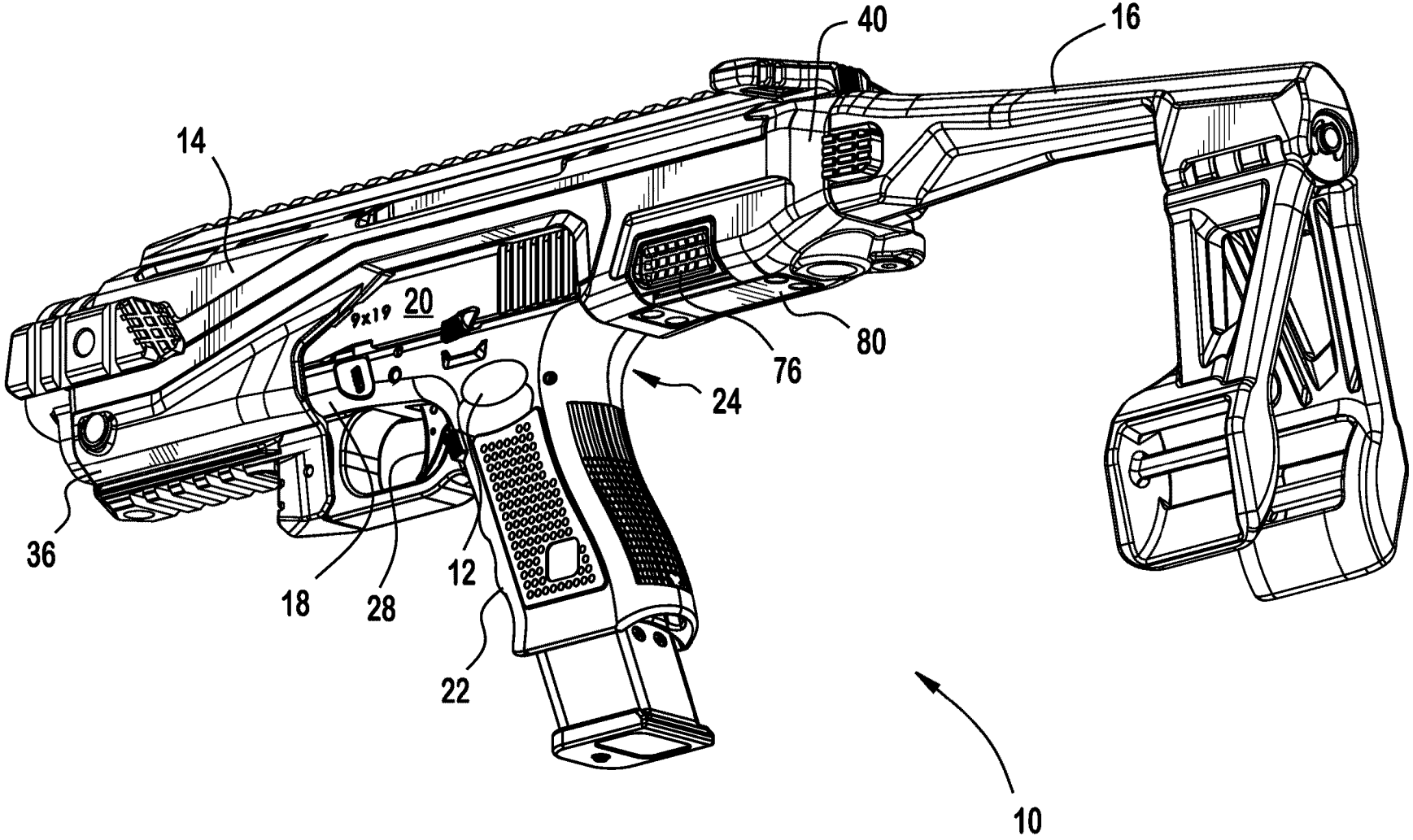
FIG. 6 is another perspective view of the firearm apparatus of FIG. 1.
Figure 14:
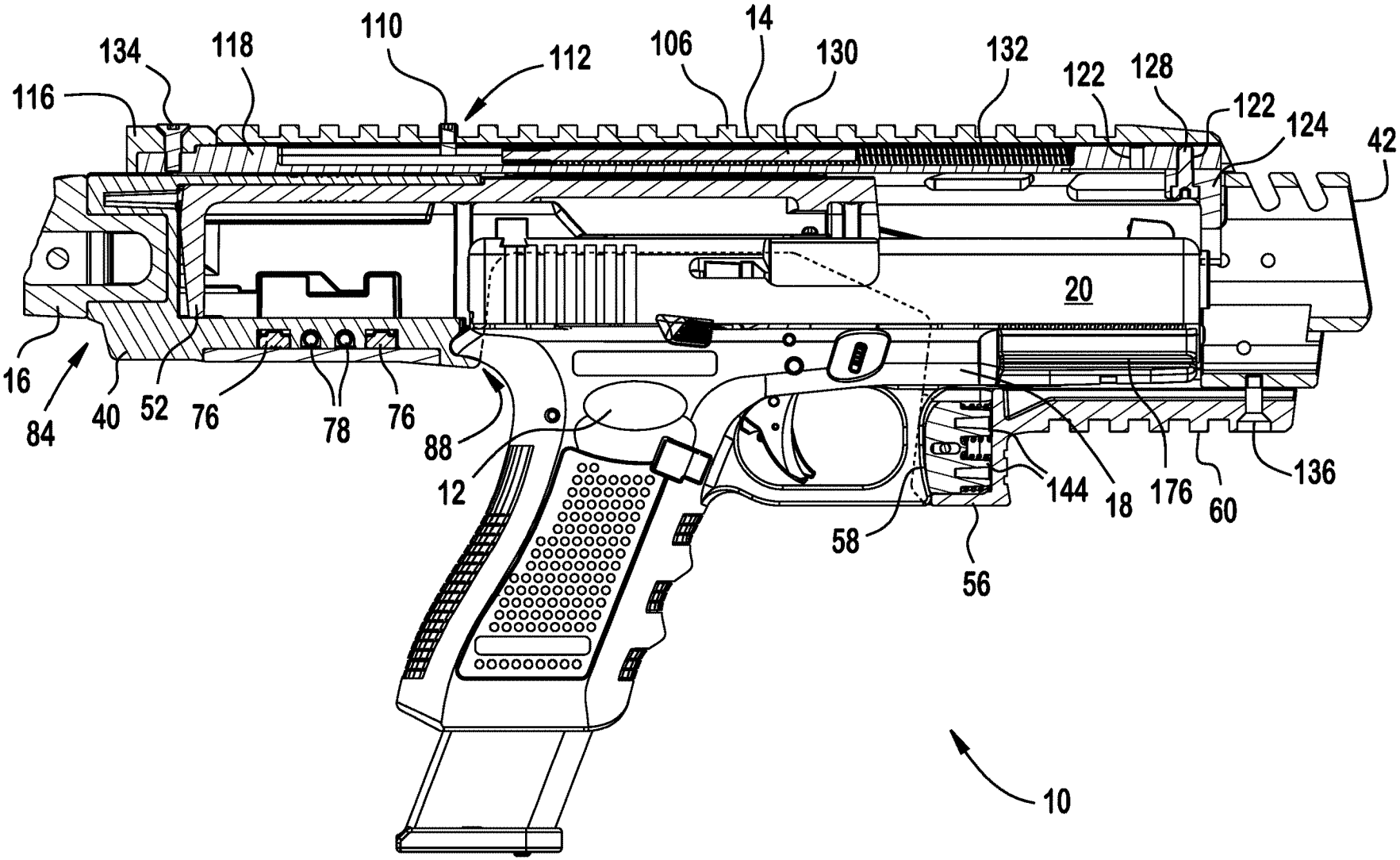
FIG. 14 is a partial sectional view of the firearm apparatus of FIG. 1.
Figure 15:
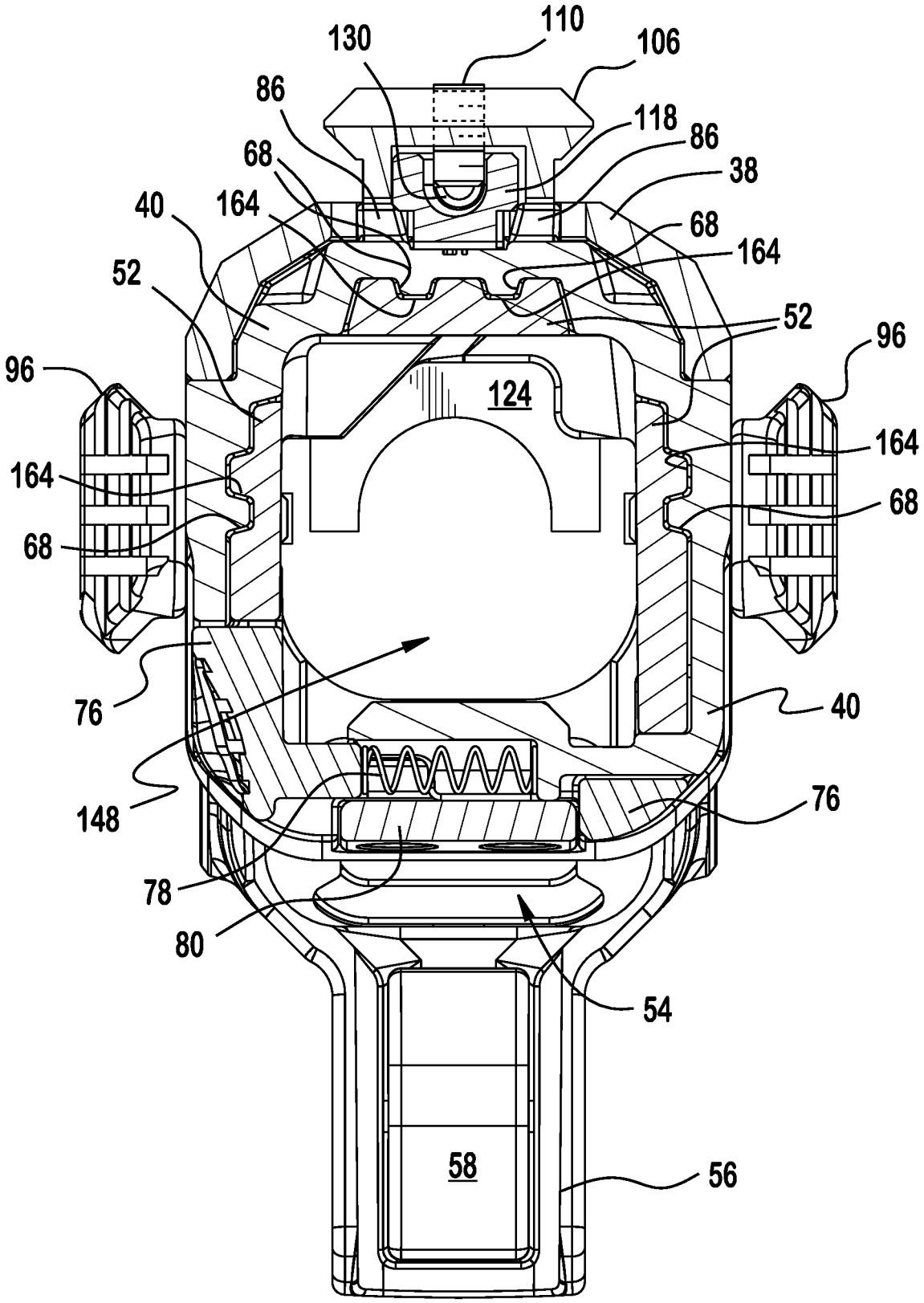
FIG. 15 is a cross-sectional view of FIG. 11 along line 15-15.

Referring to FIGS. 2 and 3, the pistol frame receptacle 54 may include a starboard side rail 170 and a port side rail 172, respectively. The pistol frame receptacle 54 may be configured and dimensioned to guide a pistol frame 18 that is inserted into the receptacle 54 such that the starboard side rail 170 and the port side rail 172 interlock with features 176 (FIG. 3), 174 (FIG. 2) on the frame of the pistol 12 to align the barrel and slide of the pistol with respect to the lower housing. For example, the pistol frame features may include grooves 174, 176 such that the starboard side rail 170 slidably receives the starboard side groove 176 and the port side rail 172 slidably receives the port side groove 174. The side rails 170, 172 may each include a segment that is aligned parallel to a longitudinal axis of the lower housing 36. Also, the side rails 170, 172 may each include an angled segment that includes a face that is oblique to the longitudinal axis of the lower housing. Referring to FIG. 15, the pistol frame receptacle 54 may be symmetrical about a vertical plane through the longitudinal axis of the lower housing 36. The pistol frame receptacle 54 may interlock with features of the pistol frame 18 to precisely and securely position the pistol slide 20 in alignment with the lower housing 36. See e.g., FIGS. 2, 3, 4, 5, 6, 7, 12, 13 and 14.

Also, the distal segment 48 of the lower housing may include a trigger guard enclosure 56. As described below with respect to FIGS. 8, 9 and 10. The trigger guard enclosure 56 may be configured and dimensioned to apply pressure to the trigger guard 26 of a pistol 12 that is properly mated with the exemplary pistol chassis 14. These features along with the clamping surface 88 of the proximal segment 50 of the lower housing 36 may hold and compress the pistol frame to securely retain the pistol in the lower housing 36. The contour of the trigger guard seat 58 may be configured and dimensioned to complement the front surface of the trigger guard 26. The lower housing distal segment further may include an accessory rail 60.

The lower housing 36 intermediate segment 50 may include a lower opening 62, a starboard opening 64, and fastener receiving bores 66. The lower opening may be configured and dimensioned to receive and accommodate the pistol slide 20 and upper portions of the pistol frame 18. The starboard opening 64 may be configured and dimensioned to allow visual inspection of the pistol chamber and passage of expelled ammunition casings during firing operations of the pistol apparatus. The fastener receiving bores may be configured and dimensioned to secure threaded fasteners which may be used to secure the upper housing to the lower housing. Each of the fastener receiving bores may include a captured nut that is configured and dimensioned to mate with one of the threaded fasteners to form a secure coupling.

The lower housing 36 proximal segment 50 further may include guide tracks 68 which slidably receive and may mate with the proximal enclosure 40 to regulate telescopic movement between those parts. Also, the intermediate segment 50 of the lower housing 36 may include a keeper 70 or blocking element 70 for a proximal latch which may be formed with the proximal enclosure 40. The proximal latch may form part of a locking mechanism which releasably fixes the telescoping components of the intermediate segment and the proximal enclosure in a collapsed configuration. The intermediate segment 50 may further include a lower opening. The lower opening 72 may be sized and positioned to allow components of the locking mechanism on the proximal segment to interact with the keeper 70.

The proximal enclosure 40 may include a locking mechanism receptacle 74. The locking mechanism receptacle may house a release button and proximal latch 76, latch springs 78, and a latch cover 80 which may be secured to the proximal enclosure by latch cover fastener screws 82. As shown in FIG. 14, the latch release button and the blocking member 72 interlock when the intermediate segment and the proximal enclosure are in a collapsed configuration. When the release button on the port side of the proximal enclosure is depressed inwardly (see e.g., FIG. 4), the proximal latch moves outwardly from the opposite side of the proximal enclosure (see e.g., FIG. 5). In the later configuration, the blocking member may not block translation of the proximal enclosure and the pistol chassis may be extended or opened into a pre-deployed configuration in which the pistol may be fitted into (or removed from) the pistol chassis.

As shown in FIG. 18, the proximal enclosure may include one or more blocking elements 86 which may interact with features in the upper housing 38 to limit translational movement of the proximal enclosure away from the lower housing 36. Also, as shown in FIGS. 11, 14, and 18, the proximal enclosure may include a clamping surface 18. The clamping surface may be configured and dimensioned to complement and/or mate with the dovetail of the pistol grip.

Referring to FIG. 18, the upper housing may include a distal segment cover 90. The distal segment cover may include a lateral accessory rail fastener opening 92 on each lateral side of the upper housing. The distal segment cover further may include a lateral fastener opening 94 next to each lateral accessory rail fastener opening 92. A lateral accessory rail 96 may be secured to the distal segment cover accessory rail fastening screw 98. These screws may be connected to the distal sleeve 42, which in turn may be secured to the lower housing by other screws (e.g. 45, 136). Further, the upper housing 36 may include an intermediate segment starboard notch 100 and fastener screw holes 102. The upper housing 36 may include a proximal segment cover 104.

Referring to FIGS. 11 and 18, the upper housing 36 may include an accessory rail 106 (e.g., picatinny rail). A charging handle track 108 may be disposed within the accessory rail 104. A charging handle retention pin 110 may be positioned in the track 108 through a retention pin opening 112 in the accessory rail 106. A charging handle assembly 114 may be disposed in the charging handle track 108. The charging handle assembly may include a handle 116 and a rail 118. The handle 116 may be an ambidextrous handle, and the rail 118 may have a I-shaped cross-section. The rail 118 may include an elongated aperture 120 and spaced fastener receiving bores 122. The bores 122 may be spaced approximately 12 mm on center along the length of the rail. Further, the charging handle assembly 114 may include a slide bracket 124 and a slide bracket fastener 128. The slide bracket fastener 128 may secure the slide bracket 124 to the rail 118. Additionally, the charging handle assembly may include a spring guide 130 and compression spring 132. A fastener 134 may fix the handle 116 to the rail 118.

Figure 8:
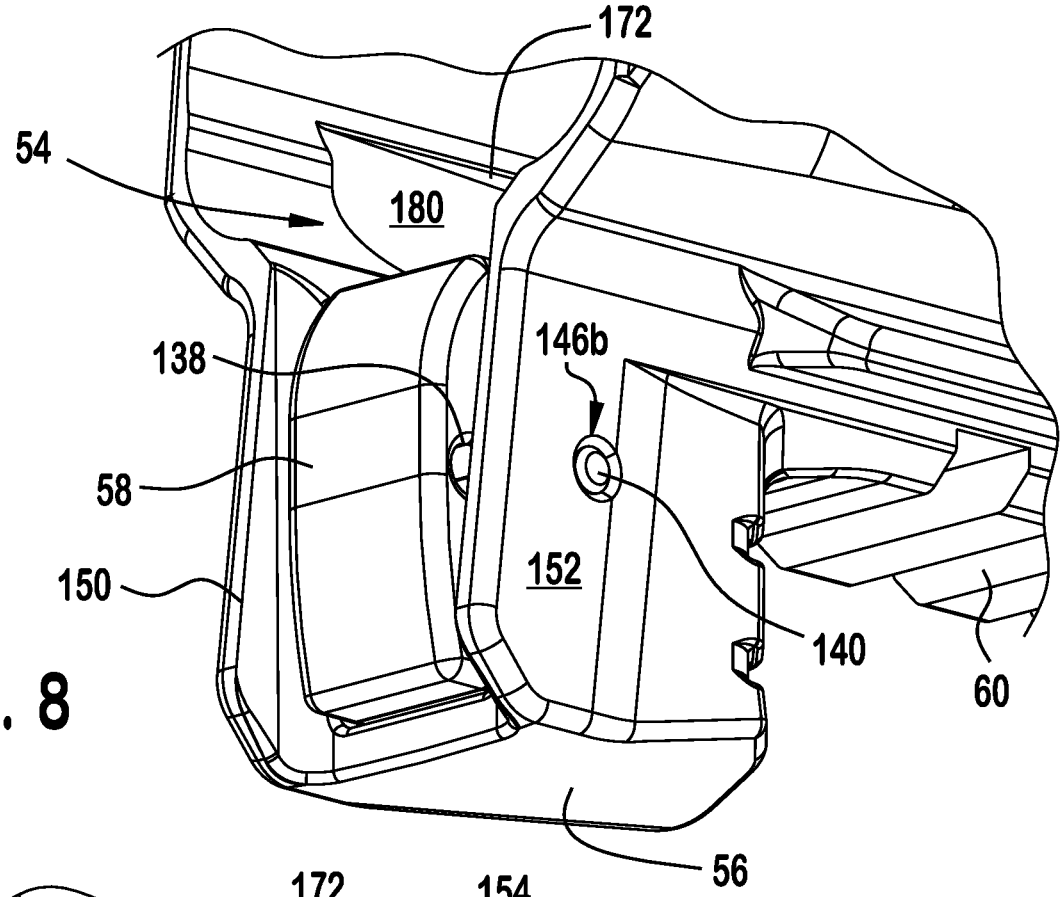
FIG. 8 is a perspective view of a trigger guard enclosure subassembly of the pistol chassis of FIG. 1.
Figure 9:
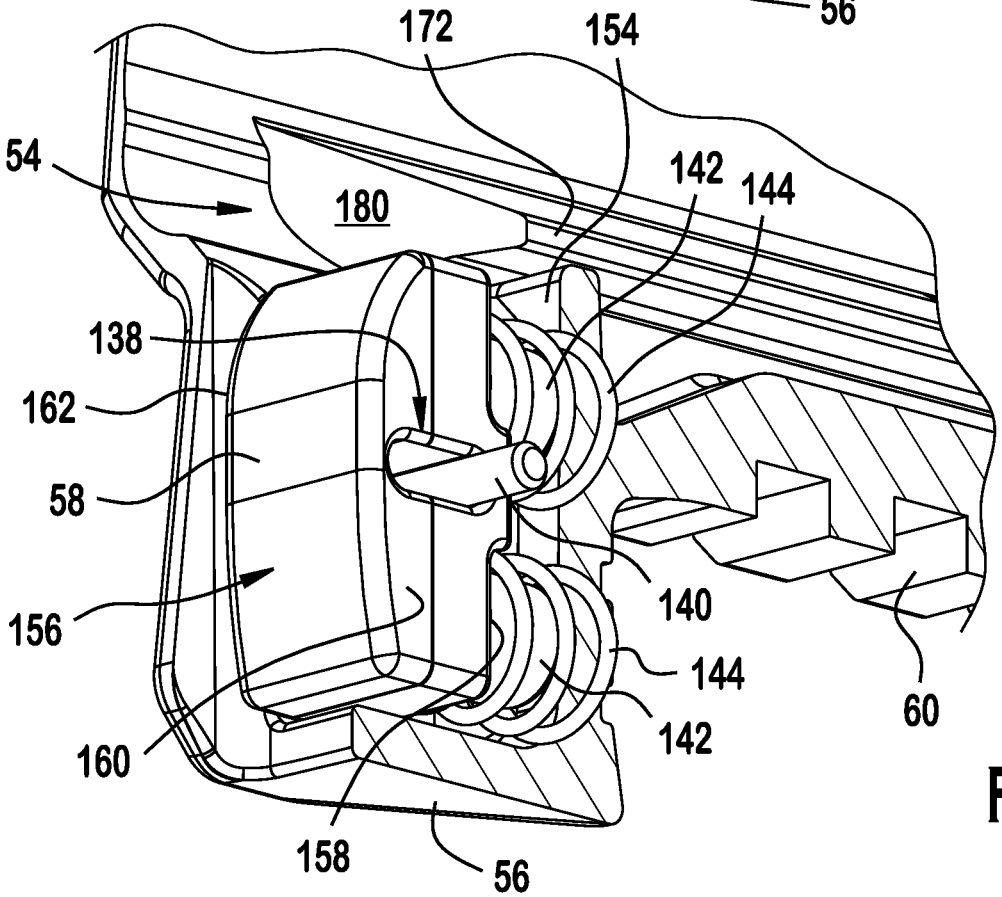
FIG. 9 is a partial sectional view the trigger guard enclosure subassembly of FIG. 8.
Figure 10:
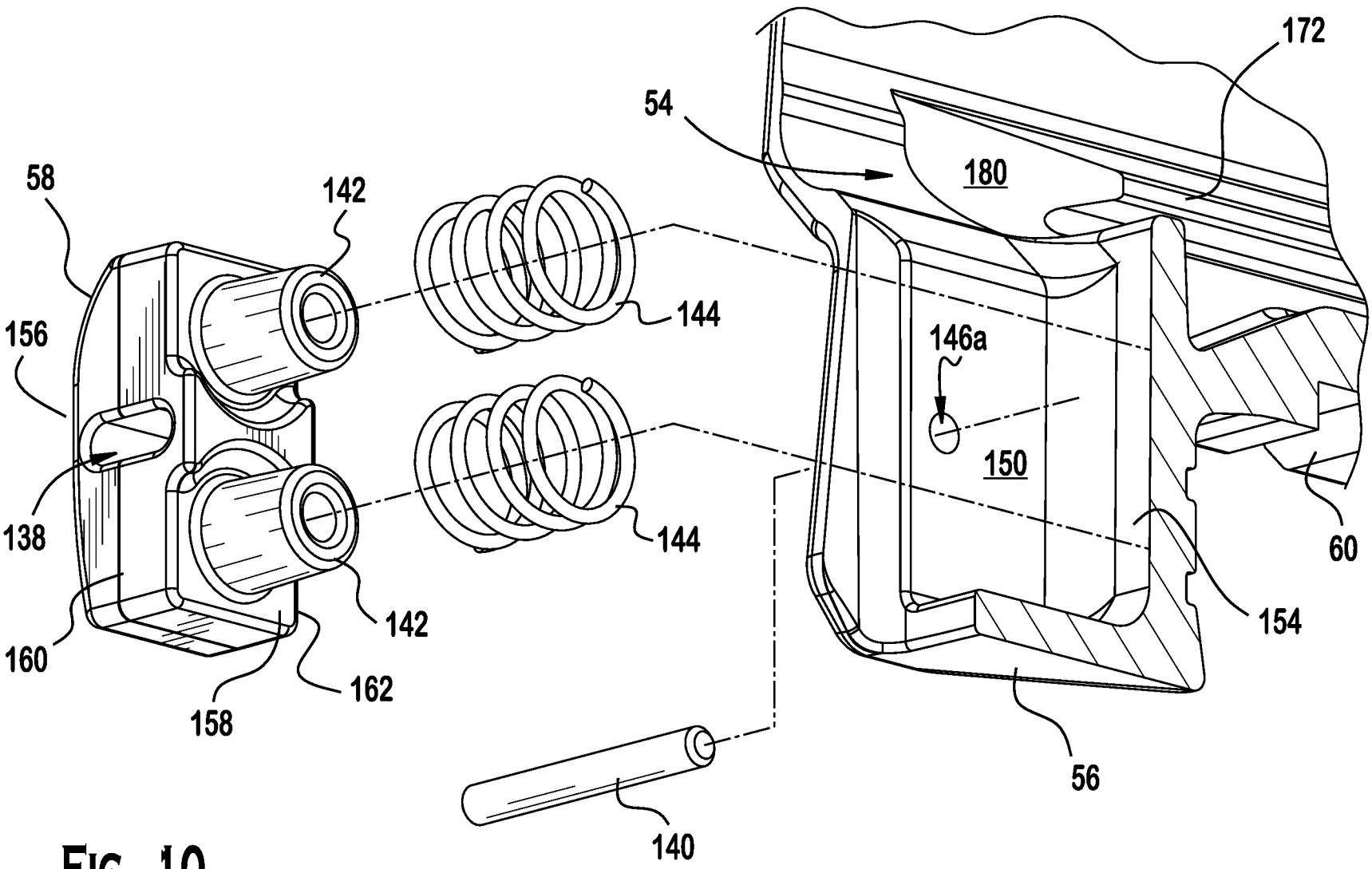
FIG. 10 is an exploded view of the trigger guard enclosure subassembly of FIG. 9.
Figure 16:
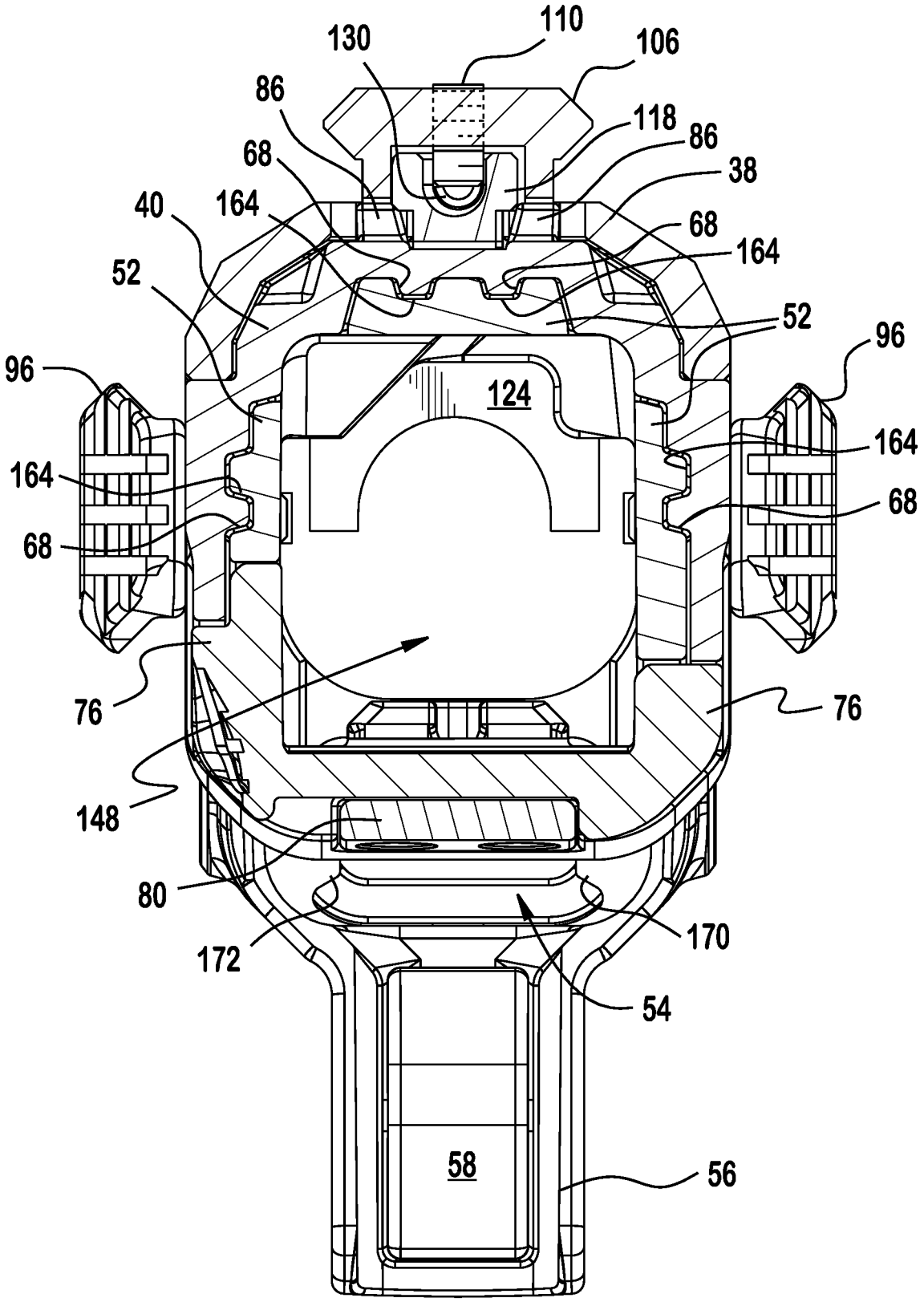
FIG. 16 is a cross-sectional view of FIG. 11 along line 16-16.
Figure 17:
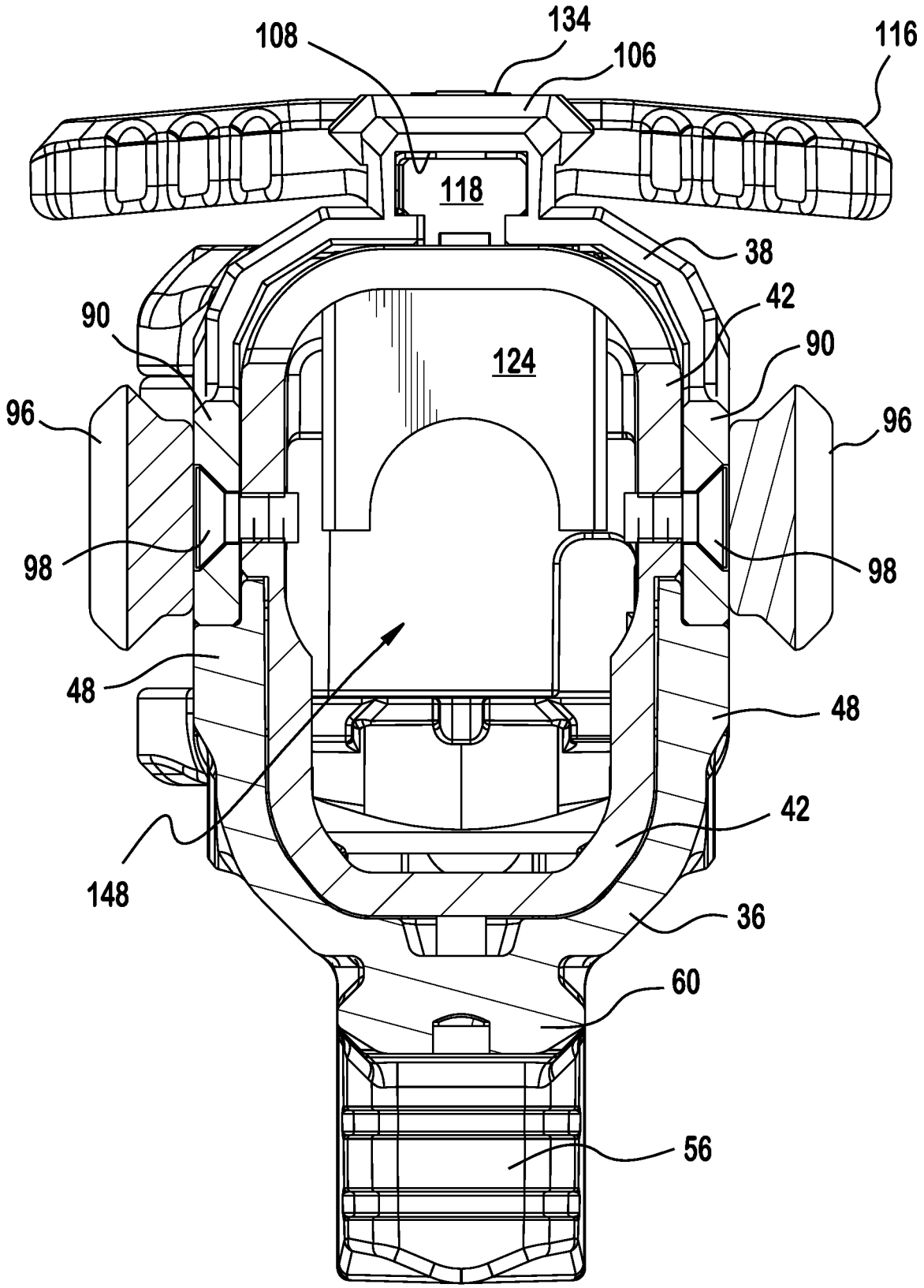
FIG. 17 is a cross-sectional view of FIG. 11 along line 17-17.

Referring to FIG. 11, the distal segment of the lower housing may include fastener screw 136, trigger guard enclosure 56, and trigger guard seat 58. Referring to FIGS. 8, 9 and 10, the trigger guard enclosure 56 may include trigger guard seat 58. The trigger guard seat 58 may include an elongated hole 138 which may receive a trigger guard seat retention pin 140. The trigger guard seat may further include spring guides 142. Helical compression springs 144 may be fitted over the spring guides 142 to bias the trigger guard seat 58 toward the proximal end of the pistol chassis. Opposing side walls of the trigger guard enclosure may include a hole 146 for receiving the retention pin. As shown in FIGS. 15, 16 and 17, the pistol chassis may form a tubular member. The tubular member may define a passage 148 for receiving and housing the pistol.

As shown in FIG. 1 and FIG. 2, a pistol chassis 14 may include a lower housing 36 and a proximal enclosure 40. Referring to FIG. 18, the lower housing 36 may include a distal end 44 and a proximal end 46. The lower housing may further include a distal segment 48 that includes a pistol frame receptacle 54 and a trigger guard enclosure 56. Referring to FIG. 10, the trigger guard enclosure 56 may include a first wall 150 including a first fastener receiving hole **146*a*. Referring to FIG. 8, the trigger guard enclosure 56 may further include a second wall 152 spaced from the first wall. Also, the second wall may include a second fastener receiving hole 146*b*. Referring to FIGS. 9 and 10, the trigger guard enclosure 56 may further include a third wall 154 disposed between the first wall 150 and the second wall 12**.

Referring to FIG. 9, the trigger guard enclosure 56 further may include a trigger guard seat 58 including a trigger guard contact surface 156, a spring guide surface 158 spaced from the trigger guard contact surface 156, a first side wall 160, a second side wall 162, a spring guide 142 extending from the spring guide surface 158, a compression spring 144 disposed around the spring guide, an elongated slot 138 extending from the first side wall 160 to the second side wall 162, and a trigger guard retention pin 140. The trigger guard retention pin 140 may be disposed in the first fastener receiving hole **146*a*, the elongated slot 138, and the second fastener receiving hole 146*b* (FIG. 8**).

Referring to FIG. 19, the lower housing 36 may include a proximal segment 52 which includes a blocking element 70 and a track 68 for guiding telescopic movement of the proximal enclosure 40. The lower housing 36 further may include an intermediate segment 50 situated between the distal segment 48 and the proximal segment 52. The intermediate segment 50 may include a lower opening 62 for receiving a pistol to be housed in the chassis and a starboard opening 64 for passage of expelled ammunition casings fired by the pistol.

The proximal enclosure 40 may be connected to the proximal segment 52. The proximal enclosure 40 may include a projection 164 (FIGS. 15 and 16) and a clamping surface 88 (FIGS. 11, 12, 13, 14 and 18) which is configured and dimensioned to interlock with a pistol grip dovetail. The proximal segment 40 further may include a proximal latch 76 for selectively locking the proximal enclosure 40 to the intermediate segment 50. The proximal enclosure 40 may be telescopically received over the proximal segment 52. Additionally, the projection 164 may be positioned in the track 68. The clamping surface 88 may be disposed opposite the pistol frame receptacle 54.

Moreover, the pistol chassis 14 may include an upper housing 38 (FIG. 18). The upper housing 38 may include a longitudinal axis, and the upper housing may include an accessory rail 106 and a charging handle track 108. The upper housing 38 further may include a charging handle assembly 114 positioned in the charging handle track 108. The charging handle assembly 114 may include a handle 116 and a rail 118. The rail 118 may include a slide bracket 124. Also, the rail 118 may include an elongated aperture 120. The charging handle assembly 114 fluffier may include a charging handle retention pin 110, and the accessory rail may include a retention pin opening 112. The charging handle retention pin 110 may be disposed in the retention pin opening 112 and the elongated aperture 120. The pistol chassis 14 further may include a distal sleeve 42. Referring to FIG. 17, the distal sleeve 42, lower housing 36, and upper housing 38 may be secured together to form a tubular member 166 defining a passage 148 for receiving a pistol 12.

Figure 7:
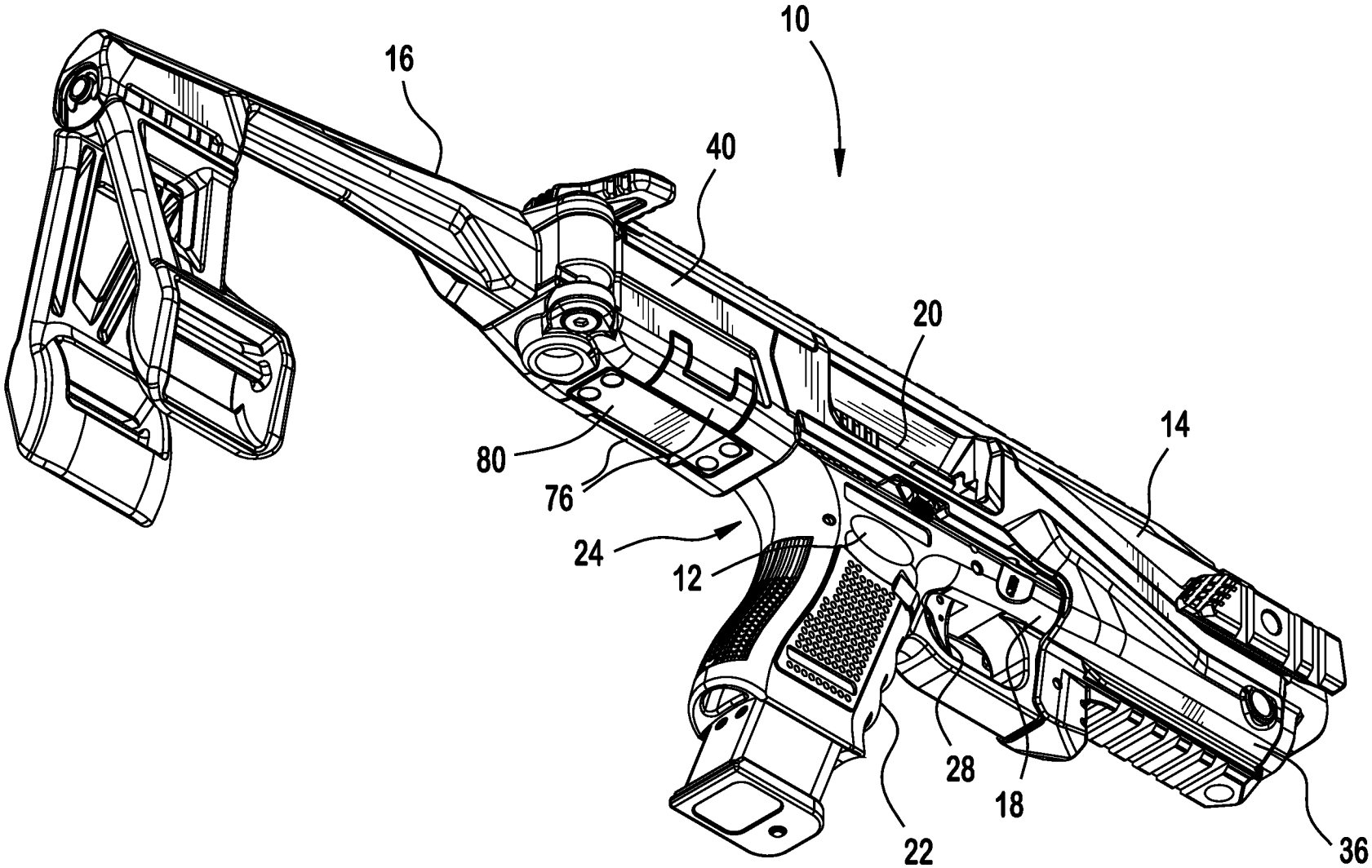
FIG. 7 is yet another perspective view of the firearm apparatus of FIG. 1.

Additionally, referring to FIG. 16, the pistol frame receptacle 54 may include a starboard side rail 170 and a port side rail 172. As shown in FIGS. 9, 10 and 11, the port side rail 172 may include a segment that is aligned parallel to a longitudinal axis of the lower housing 36 and an angled segment that includes a face 180 which is oblique to the longitudinal axis of the lower housing 36. Referring to FIG. 16, the starboard side rail 170 and the port side rail 172 may be configured and dimensioned to interlock with a housed pistol frame 18 to precisely and securely position the housed pistol frame 20 in alignment with the longitudinal axis of the lower housing 36 (FIG. 7).

Referring to FIG. 19, the pistol chassis 14 may further include a proximal accessory 16 connected to the proximal enclosure 40. The proximal accessory 16 may include a buttstock 182. The proximal accessory 16 may be a folding stock. Referring to FIG. 1, the proximal accessory 16 may be an arm stabilizing device 184. More particularly, the proximal accessory 16 may include an arm support 186. The arm support 186 may form part of a yolk for resting on a forearm of an operator. The proximal accessory 16 and the pistol chassis 14 may form a hinge 188 about the accessory coupling site 84, the arm support 184 being selectively rotatable about the accessory coupling site 84 to achieve a compact or folded configuration (not shown). Also, the pistol chassis 14 may house a pistol 12 to produce a firearm apparatus 10. For example, a firearm apparatus 10 may include a pistol 12 disposed in the lower housing 36, the pistol 12 contacting the trigger guard seat 58 and the clamping surface 88.

In use, an operator may unlock the locking mechanism by depressing the release button. Then the operator may open the pistol chassis to the extended configuration by moving the proximal enclosure away from the distal end of the pistol chassis. The pistol muzzle may then be inserted into the lower opening and advanced into the passage toward the distal end of the pistol chassis until the forward face of the slide is opposed to the slide bracket.

At the same time, the forward accessory rail of the pistol may be slidably received within the pistol frame receptacle. The trigger guard of the pistol may be pressed against the trigger guard seat. The dovetail of the pistol grip may then be aligned with the clamping surface of the proximal enclosure. The proximal enclosure may then be telescopically collapsed on the proximal segment of the lower housing until the locking mechanism engages. In this configuration the pistol is secured pressed into the clamping surface by spring forces acting on the trigger guard vis the trigger guard seat.

A magazine with ammunition cartridges may be loaded into the magazine well, and the pistol loaded by drawing the charging handle rearward such that the slide bracket pulls the slide backward to chamber a round of ammunition. The charging handle spring may then return the charging handle and slide bracket to the forward position. After a round is chambered the firearm apparatus may be aimed and fired. To remove the pistol from the pistol chassis, the pistol chassis may be opened to the extended position, and the pistol slidably withdrawn from the passage and pistol frame receptacle.

While it has been illustrated and described what at present are considered to be preferred embodiments of the present invention, it will be understood by those skilled in the art that various changes and modifications may be made, and equivalents may be substituted for elements thereof without departing from the true scope of the invention. For example, the shape, materials of construction, and spring force of the springs may be adapted for use with a particular pistol geometry. Additionally, features and or elements from any embodiment may be used singly or in combination with other embodiments. Therefore, it is intended that this invention not be limited to the particular embodiments disclosed herein, but that the invention include all embodiments falling within the scope and the spirit of the present invention.

What is claimed is:

1. A pistol chassis comprising:

a lower housing which comprises a distal end and a proximal end, the proximal end being spaced from the distal end along a first longitudinal axis, the lower housing comprises a distal segment comprising a pistol frame receptacle which comprises a starboard side rail and a port side rail, the starboard side rail and the port side rail being configured and dimensioned to interlock with a housed pistol frame to precisely and securely position the housed pistol frame in alignment with the first longitudinal axis, and a trigger guard enclosure which comprises a first wall including a first fastener receiving hole, a second wall spaced from the first wall, the second wall including a second fastener receiving hole, and a third wall disposed between the first wall and the second wall, a trigger guard seat comprising a trigger guard contact surface, a spring guide surface spaced from the trigger guard contact surface, a first side wall, a second side wall, a spring guide extending from the spring guide surface, a compression spring disposed around the spring guide, an elongated slot extending from the first side wall to the second side wall, and a trigger guard retention pin, the trigger guard retention pin being disposed in the first fastener receiving hole, the elongated slot, and the second fastener receiving hole, a proximal segment comprising a blocking element and a track, an intermediate segment situated between the distal segment and proximal segment, the intermediate segment comprising a lower opening for receiving a pistol and a starboard opening for passage of fired ammunition casings, and a proximal enclosure connected to the proximal segment, the proximal enclosure comprising a projection, a clamping surface which is configured and dimensioned to interlock with a pistol grip dovetail, and a proximal latch for selectively locking the proximal enclosure to the intermediate segment, the proximal enclosure being telescopically received on the proximal segment, the projection being positioned in the track, and the clamping surface being disposed opposite the pistol frame receptacle.

2. The pistol chassis of claim 1, further comprising an upper housing.

3. The pistol chassis of claim 2, wherein the upper housing comprises a longitudinal axis, the upper housing comprising an accessory rail and a charging handle track.

4. The pistol chassis of claim 3, wherein the upper housing further comprises a charging handle assembly positioned in the charging handle track.

5. The pistol chassis of claim 4, wherein the charging handle assembly comprises a handle and a rail.

6. The pistol chassis of claim 5, wherein the rail comprises a slide bracket.

7. The pistol chassis of claim 6, wherein the rail comprises an elongated aperture.

8. The pistol chassis of claim 7, wherein the charging handle assembly further comprises a charging handle retention pin, the accessory rail further comprises a retention pin opening, and the charging handle retention pin is disposed in the retention pin opening and the elongated aperture.

9. The pistol chassis of claim 2, further comprising a distal sleeve.

10. The pistol chassis of claim 9, wherein the distal sleeve, lower housing, and upper housing are secured together to form a tubular member for receiving a pistol.

11. The pistol chassis of claim 1, further comprising a proximal accessory connected to the proximal enclosure.

12. The pistol chassis of claim 11, wherein the proximal accessory comprises a butt stock.

13. The pistol chassis of claim 12, wherein the proximal accessory comprises a folding stock.

14. The pistol chassis of claim 11, wherein the proximal accessory comprises an arm stabilizing device.

15. The pistol chassis of claim 14, wherein the proximal accessory comprises an arm support.

16. The pistol chassis of claim 15, wherein the arm support and the pistol chassis form a hinge, and the arm support is selectively movable about the hinge.

17. The pistol chassis of claim 1, wherein the starboard side rail comprises a segment that is aligned parallel to the first longitudinal axis and an angled segment which includes a face that is oblique to the first longitudinal axis.

18. A firearm apparatus comprising:

a pistol chassis of claim 1, and a pistol disposed in the lower housing, the pistol contacting the trigger guard seat and the clamping surface.

19. A pistol chassis comprising:

a lower housing which comprises a distal end and a proximal end, the lower housing comprises a distal segment comprising a pistol frame receptacle, and a trigger guard enclosure, the trigger guard enclosure comprises a first wall including a first fastener receiving hole, a second wall spaced from the first wall, the second wall including a second fastener receiving hole, and a third wall disposed between the first wall and the second wall, a trigger guard seat comprising a trigger guard contact surface, a spring guide surface spaced from the trigger guard contact surface, a first side wall, a second side wall, a spring guide extending from the spring guide surface, a compression spring disposed around the spring guide, an elongated slot extending from the first side wall to the second side wall, a trigger guard retention pin, the trigger guard retention pin being disposed in the first fastener receiving hole, the elongated slot, and the second fastener receiving hole, a proximal segment comprising a blocking element and a track, an intermediate segment situated between the distal segment and proximal segment, the intermediate segment comprising a lower opening for receiving a pistol and a starboard opening for passage of fired ammunition casings, a proximal enclosure connected to the proximal segment, the proximal enclosure comprising a projection, a clamping surface which is configured and dimensioned to interlock with a pistol grip dovetail, and a proximal latch for selectively locking the proximal enclosure to the intermediate segment, the proximal enclosure being telescopically received on the proximal segment, the projection being positioned in the track, and the clamping surface being disposed opposite the pistol frame receptacle, and an upper housing comprising an accessory rail which comprises a retention pin opening, and a charging handle track, and a charging handle assembly positioned in the charging handle track, the charging handle assembly comprising a handle, a rail which comprises a slide bracket and an elongated aperture, and a charging handle retention pin, the charging handle retention pin being disposed in the retention pin opening and the elongated aperture.

20. The pistol chassis of claim 19, further comprising a butt stock connected to the proximal enclosure.

* * * * *